US010132101B1

(12) United States Patent
Hongthong

(10) Patent No.: US 10,132,101 B1
(45) Date of Patent: Nov. 20, 2018

(54) ROTATABLE LEGS FOR SECURITY BARRICADES

(71) Applicant: Thanomsak Hongthong, Brooklyn, NY (US)

(72) Inventor: Thanomsak Hongthong, Brooklyn, NY (US)

( * ) Notice: Subject to any disclaimer, the term of this patent is extended or adjusted under 35 U.S.C. 154(b) by 0 days.

(21) Appl. No.: 15/725,278

(22) Filed: Oct. 4, 2017

(51) Int. Cl.
*E04H 17/20* (2006.01)
*E01F 13/02* (2006.01)

(52) U.S. Cl.
CPC ..... *E04H 17/20* (2013.01); *E01F 13/022* (2013.01)

(58) Field of Classification Search
CPC . E01F 13/00; E01F 13/02; E01F 13/22; E01F 9/688; E01F 9/692; E01F 9/669; E04H 17/18; E04H 17/20
See application file for complete search history.

(56) References Cited

U.S. PATENT DOCUMENTS 3,057,601 A * 10/1962 Simpson ..... E01F 13/02 256/59
4,288,052 A * 9/1981 Scott ..... F16M 11/38 248/158
5,031,683 A * 7/1991 Marvy ..... A47G 5/00 160/351
5,419,065 A * 5/1995 Lin ..... B60Q 7/00 40/550
5,875,578 A * 3/1999 Grewe ..... G09F 15/0056 248/346.2
6,257,559 B1 * 7/2001 Mouri ..... E01F 13/022 160/135
6,315,251 B1 * 11/2001 Stoudt ..... E04H 12/2238 248/156
6,676,113 B2 * 1/2004 Christensen ..... E01F 13/022 160/351
7,540,682 B1 * 6/2009 Christensen ..... E01F 13/022 116/63 P
D599,488 S * 9/2009 Christensen ..... D25/48.5
7,631,409 B2 * 12/2009 Dehlsen ..... E04H 12/2238 256/24
9,624,630 B1 4/2017 Maus et al.
2007/0241255 A1 * 10/2007 Dvoracek ..... G09F 15/0056 248/346.01
2017/0016243 A1 * 1/2017 Testa ..... E04H 12/2261

FOREIGN PATENT DOCUMENTS

WO WO-2016139486 A1 * 9/2016 ..... E04H 12/2238

* cited by examiner

*Primary Examiner* — Jonathan P Masinick

(57) ABSTRACT

The rotatable leg provides a way to quickly setup a security barricade without the need for fasteners or tools. The leg is permanently attached to the security barrier frame and can be rotated 90 degrees in order to align the feet either in line or perpendicular to the barricade frame. The leg uses a simple spring and washer mechanism to provide holding force to the frame while also allowing the leg to be rotated in the desired position using a V notch surface that mates to the bottom crossbar of the barricade. This leg can be easily rotated 90 degrees using only hand pressure without any tools. This invention provides not only a quick setup of the barricade but also prevents loss of parts such as pins or other fasteners used with detachable feet in typical barricades.

1 Claim, 5 Drawing Sheets

PRIOR ART

ROTATABLE LEGS FOR SECURITY BARRICADES

FIELD OF THE INVENTION

The present invention relates to the field of security barricades and more particularly to a rotatable leg mounted to the frame of the barricade to allow the legs to rotate in a flattened position for ease of storage.

BACKGROUND OF THE INVENTION

There are a variety of security barricades sold today for applications such as crowd control. Typically these barricades are constructed of tubular steel that is welded or fastened together to create a gate with two feet. The feet are typically either flat bars or can be a U shape. The feet are typically stored separately when the barricades are in storage and then are connected to the barricade frame using fasteners such as pins or screws. This assembly process takes time to assemble each barricade and can easily add up to many hours when preparing for a large event such as a parade.

It is an object of the present invention to provide a leg that is permanently attached to the security barrier frame but can be rotated 90 degrees in order to align the feet parallel in line with the barricade frame. The leg uses a simple spring with two washers to provide holding force to the frame while also allowing the leg to be rotated using a V notch surface that mates to the bottom crossbar of the barricade. This leg can be easily rotated 90 degrees using only hand pressure without the need for tools. This invention provides not only a quick setup of the barricade but also prevents loss of parts such as pins or other fasteners used with detachable feet in typical barricades.

BRIEF SUMMARY OF THE INVENTION

The invention provides a rotatable leg to be used in conjunction with security barricades constructed from tubular steel. The leg consists of a main post of square cross section with flat feet at the bottom end and a tapped hole centered at the top end. Each face of the top of the post has a symmetrical V shaped notch cut through to the other side. This creates a V shaped notch with four beveled corners to mate tangentially to the tubular steel lower crossbar of the security barricade. A threaded rod of approximately seven inches is fastened to the tapped hole at the top of the post and slides through a mating hole at the mounting location on the lower crossbar of the security barricade.

Once the threaded rod is fit to the barricade crossbar, the leg is assembled to the barricade using a washer followed by a compression spring followed by a second washer and finished with a locknut at the top end of the threaded rod. The compression spring has a length suitable for providing a compressive force to keep the leg attached to the barricade. The V notch design of the post allows the leg to be rotated in either a perpendicular orientation to the barricade for use or in a parallel orientation for flat storage of the barricade. The legs are easily rotated in the desired position simply by pulling the leg and barricade away from each using only hand strength. This compresses the spring and creates a small gap between the barricade crossbar and the post allowing the post to be rotated by hand. Releasing tension on the leg and barricade will then allow the spring to expand and apply pressure against the barricade crossbar to hold the leg in its new position.

DETAILED DESCRIPTION OF THE INVENTION

Figure 1:
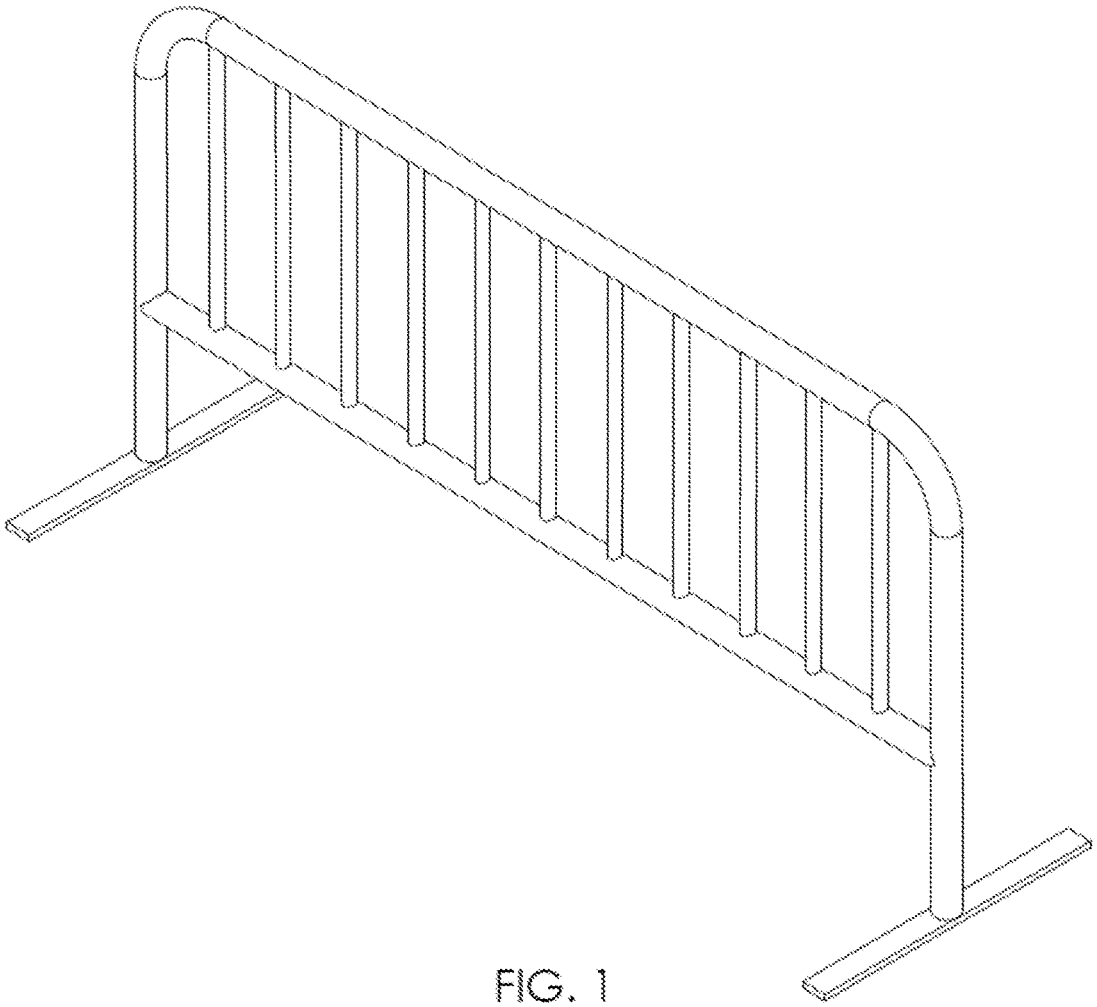
FIG. 1 is a perspective view of a prior art security barricade.
Figure 2:
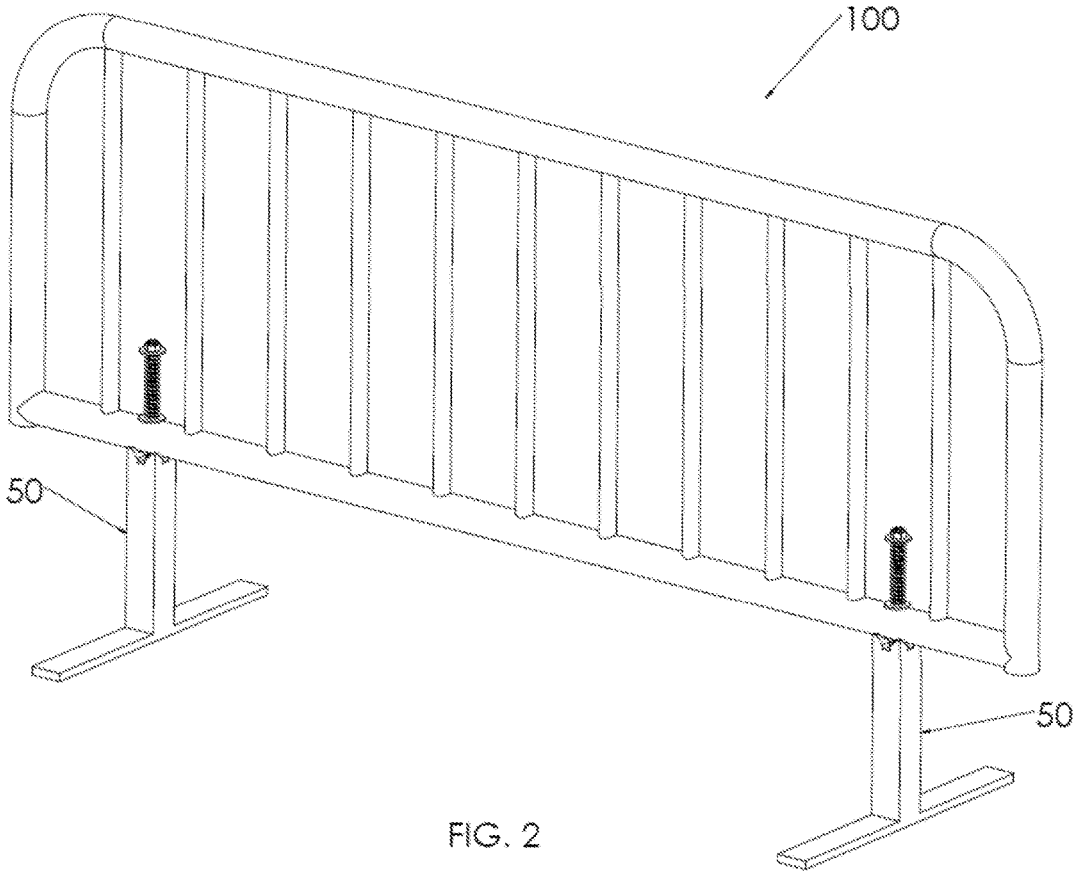
FIG. 2 is a perspective view of a security barricade mounted with rotatable legs oriented in a deployed position.

Referring now to the drawings and in particular FIG. 1, a typical prior art security barricade is shown. The barricade typically has at least two feet that are located at each end of the barricade frame. Barricades of prior art may have permanent welded feet that are fixed or detachable feet that are mounted to the barricade using pins or other fasteners Referring next to FIG. 2, a security barricade with rotatable legs 100 is shown with the bottom feet of the legs 50 oriented perpendicular to the barricade. This would be the normal orientation for using the barricade. Each leg 50 is attached to the barricade lower crossbar using a single mounting hole located inboard from each end of the barricade and in between two support bars as shown.

Figure 3:
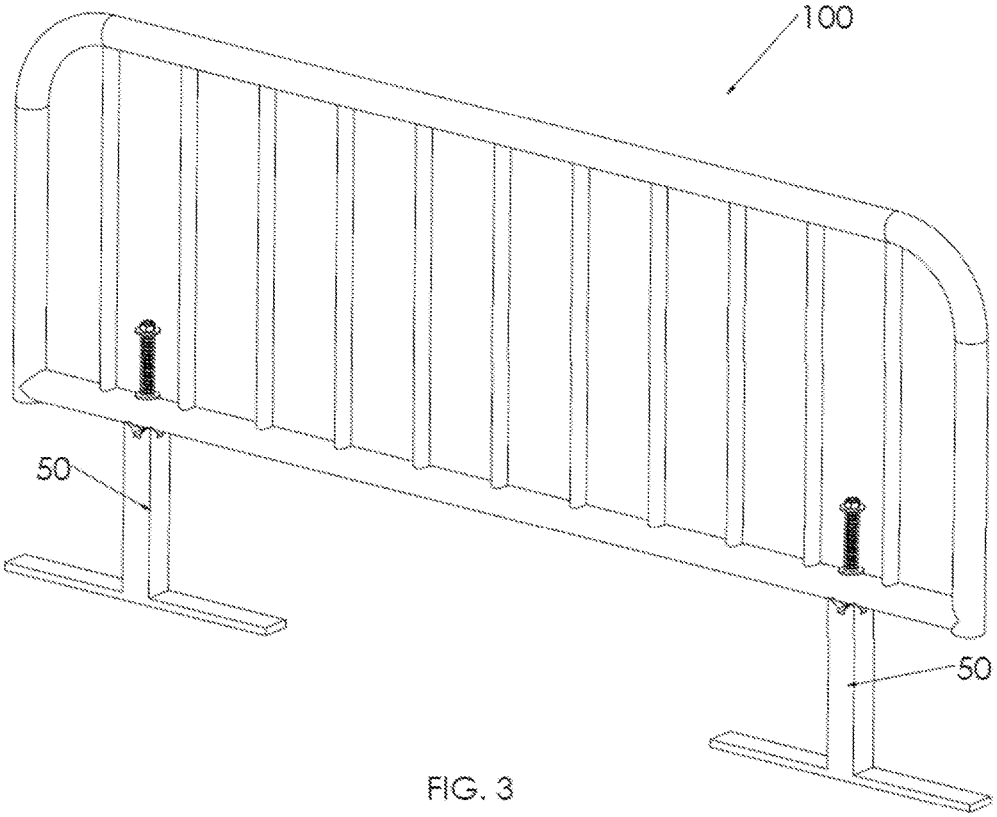
FIG. 3 is a perspective view of a security barricade mounted with rotatable legs oriented in a flat storage position.

Referring next to FIG. 3, a security barricade with rotatable legs 100 is shown with the bottom feet of the legs 50 oriented parallel to the barricade. This would be the normal orientation for storing the barricade. Mounting the legs 50 inboard allows the feet to stay within the overall length of the barricade to provide a minimal space for storage.

Figure 4:
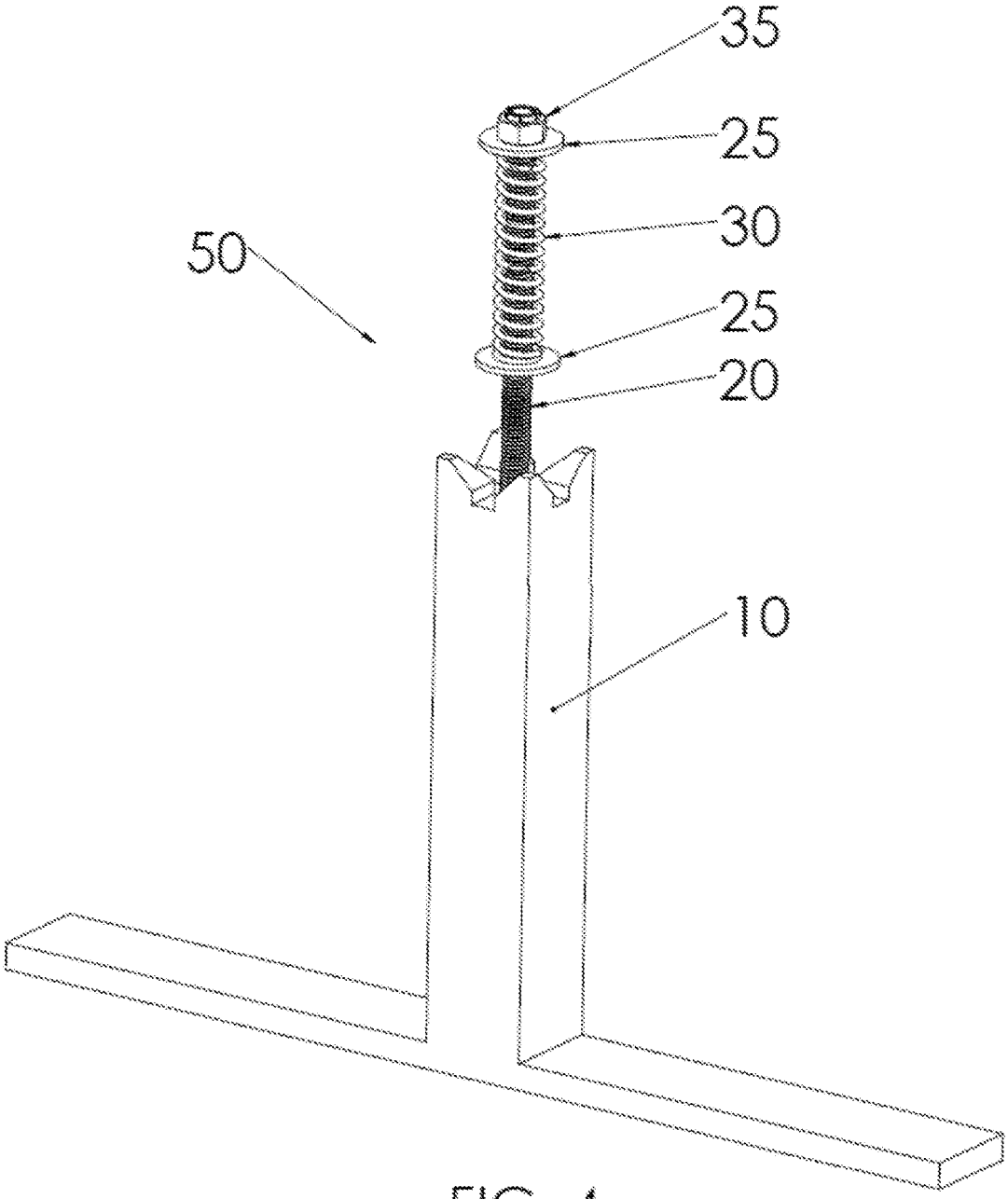
FIG. 4 is a perspective view of the rotatable leg apparatus.

Referring next to FIG. 4, the rotatable leg 50 is shown. The rotatable leg consists of a square post 10, a threaded rod 20, a compression spring 30 with flat washers 25 at each end, and a locking nut 35 at the distal end of the threaded rod. The square post 10 has a square cross section with flat feet protruding approximately one foot from each end. The post 10 has a tapped blind hole centered at the top end. Each face of the top of the post has a symmetrical V shaped notch cut through to the other side. This creates a V shaped notch with four beveled corners to mate tangentially to the tubular steel lower crossbar of the security barricade. The threaded rod 20 is preferably approximately seven inches in length and is rigidly attached to the tapped hole at the top of the post. The threaded rod 20 mounts to the lower crossbar 60 of the barricade through a corresponding mating hole. Once the threaded rod is slipped through the barricade crossbar mounting hole, the leg 50 is assembled to the barricade using a first flat washer 25 followed by a compression spring 30 followed by a second washer 25 and completed with a locking nut 35 at the top end of the threaded rod. The compression spring has a length suitable for providing a compressive force to keep the leg attached to the barricade. The V notch design of the post 10 allows the leg 50 to be rotated in either a perpendicular orientation to the barricade for use or in a parallel orientation for flat storage of the barricade. The legs are easily rotated in the desired position simply by pulling the leg and barricade away from each using only hand strength. This compresses the spring 30 and creates a small gap between the barricade crossbar 60 and the top end of the post to allow the leg 50 to be rotated using only hand force. Releasing tension on the leg 50 and barricade will then allow the spring 30 to expand and apply pressure against the barricade crossbar 60 to securely hold the leg 50 in the desired position.

Figure 5:
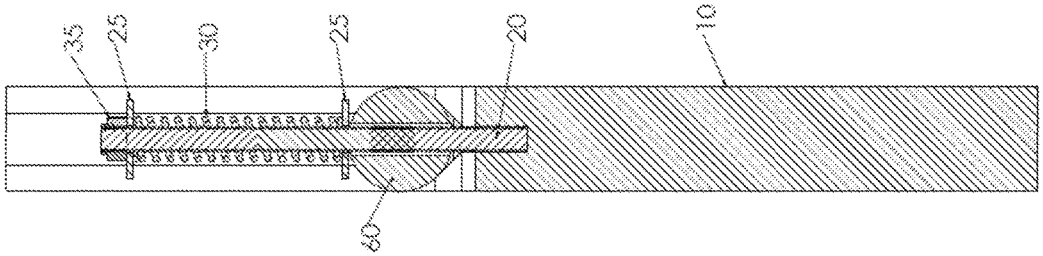
FIG. 5 is a cross section view of the rotatable leg apparatus mounted to the security barricade crossbar.
Figure 5:
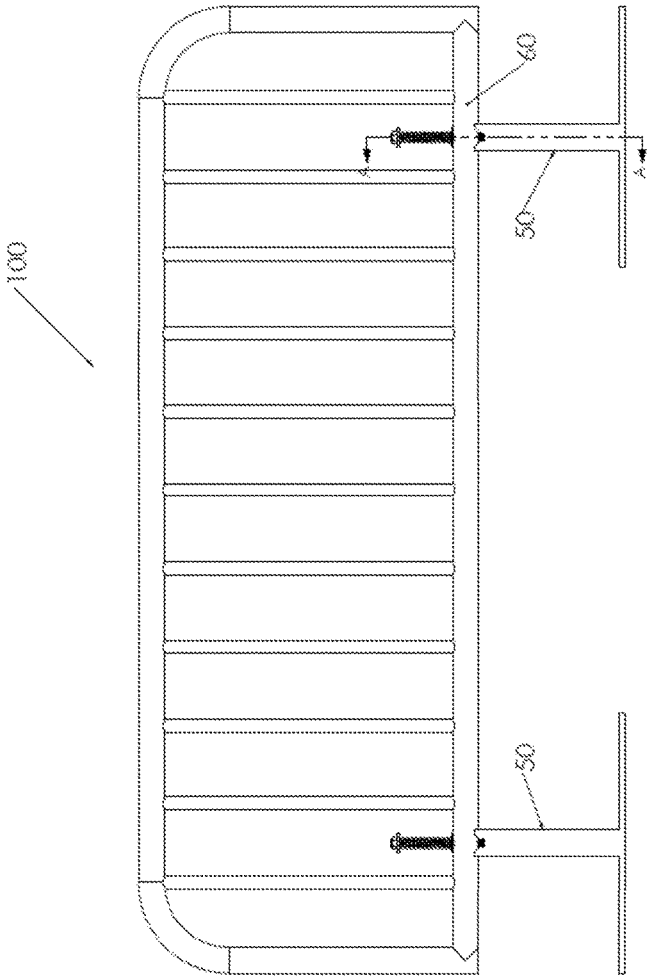

Referring next to FIG. 5, the pressure sensing shoe 200 is shown in cross section to include the preferred locations of the pressure sensors 220, the connecting wiring 230 and the shoe electronic module 210. In the preferred embodiment, these components are preferably embedded in the insole component of the shoe so that they are protected from exposure to outside elements. If a pressure sensing shoe 200 no longer works (for example from a dead battery or sensor), the insole can be replaced with a new insole to resume pressure monitoring.

Referring finally to FIG. 5, a cross section of the rotatable leg 50 mounted to the lower crossbar 60 of the security barricade is shown along section line A-A of security barricade 100. The threaded rod 20 is approximately ⅜ to ½ inch in diameter and is rigidly fastened to the post 10 using a tapped hole centered at the bottom flat of the V notch cut. The barricade lower crossbar 60 is shown with the mounting hole through which passes the threaded rod 20. The crossbar 60 is held in position at the top of the post 10 at the V notch surface as shown. The compression spring 30 and washers 25 apply a compressive force to keep the leg secured to the crossbar of the barricade. The spring 30 is sized to allow hand force to rotate the leg 50 without the need for any tools.

What is claimed is:

1. A rotatable leg apparatus for use with security barricades comprising:

a steel square post having at one end two flat feet projected approximately twelve inches outboard and at the opposite end a V notch cut on all four sides of said post with a centered tapped threaded hole at least one inch in depth;

a steel fully threaded rod between ⅜ and inch in diameter and approximately seven inches in length;

said threaded rod rigidly attached to a top end of said post and located at the center of said post using said centered tapped threaded hole at said post;

a first flat washer oriented concentric to said threaded rod and tangential to a tubular surface of said security barricade;

a compression spring oriented concentric to said threaded rod and tangential to an upper face of said first washer;

a second flat washer oriented concentric to said threaded rod and mated to an upper end of said compression spring; and a locking nut rigidly attached to a distal top end of said threaded rod and mated against a top face of said second flat washer.

* * * * *